United States Patent [19]

Schroeder et al.

[11] 4,208,166

[45] Jun. 17, 1980

[54] ADJUSTABLE WEAR RING FOR A CENTRIFUGAL PUMP

[75] Inventors: Earle E. Schroeder, New Richmond; John D. Campbell, Cincinnati, both of Ohio

[73] Assignee: Allis-Chalmers Corporation, Milwaukee, Wis.

[21] Appl. No.: 906,101

[22] Filed: May 15, 1978

[51] Int. Cl.[2] ..... F04D 29/08; F16H 1/08

[52] U.S. Cl. ..... 415/170 A; 415/171; 74/424.8 R

[58] Field of Search ..... 415/128, 170 R, 170 A, 415/171; 74/424.8 R

[56] References Cited

U.S. PATENT DOCUMENTS

| | | | |
|---|---|---|---|
| 1,114,238 | 10/1914 | Doble | 415/171 |
| 3,460,843 | 8/1969 | Jaeger | 415/170 A |
| 3,798,984 | 3/1974 | McMinn | 74/424.8 R |
| 4,037,985 | 7/1977 | Karassik et al. | 415/170 A |
| 4,131,386 | 12/1978 | Mabe, Jr. | 415/170 A |

FOREIGN PATENT DOCUMENTS

| | | | |
|---|---|---|---|
| 222770 | 10/1924 | United Kingdom | 415/170 A |
| 242230 | 5/1926 | United Kingdom | 415/170 A |

*Primary Examiner*—John J. Vrablik
*Attorney, Agent, or Firm*—Robert C. Jones

[57] ABSTRACT

An adjustable wear ring between a pump impeller and the pump casing is provided which is rotatable relative to the casing for effecting an adjustment of the wear ring with respect to the impeller to restrict leakage between the high pressure and low pressure chambers of the pump. Spiral groove formed on the periphery of the wear ring right engage with an action pin extending radially from the casing bore to effect controlled axial movement of the wear ring. A pin is inserted through the wear ring to engage the bore of the casing to lock the wear ring in adjusted position.

2 Claims, 3 Drawing Figures

ADJUSTABLE WEAR RING FOR A CENTRIFUGAL PUMP

SUMMARY AND BACKGROUND OF THE INVENTION

This invention relates to centrifugal pumps and more specifically to the wear rings therein.

In pumps of the type illustrated herein it is necessary to provide a seal between the suction and discharge cavities and to provide a wear surface for the fluid passing from the discharge cavity back into the suction cavity. In the prior art the wear ring has been rigidly contained in the pump casing as disclosed in U.S. Pat. No. 2,604,050. Other prior art patents, such as U.S. Pat. No. 3,512,788, disclose means for the self-adjustment of wear rings. However, in the case of self-adjusting wear rings, it is difficult to determine when adjustment should be made and how much of an adjustment has been accomplished.

OBJECTS OF THE INVENTION

It is therefore the general object of this invention to provide a wear ring and seal between the pump impeller and the pump casing which is an independent component capable of being easily adjusted.

A more specific object of this invention is to provide a wear ring which can be easily replaced and which can also be adjusted axially to establish a desired clearance between the impeller and the wear ring to restrict leakage from the discharge cavity back into the suction cavity.

A still further object of this invention is to provide a wear ring which can be positively locked in an adjusted position.

A further object of this invention is to provide an axially adjustable wear ring which fits within a smooth bore in the pump casing but which is provided with means to advance the wear ring axially in a controlled movement and also has means to lock the wear ring from inadvertent rotation.

These and other objects of this invention will become more fully apparent from the accompanying description in conjunction with the attached drawings:

DETAILED DESCRIPTION

Figure 1:
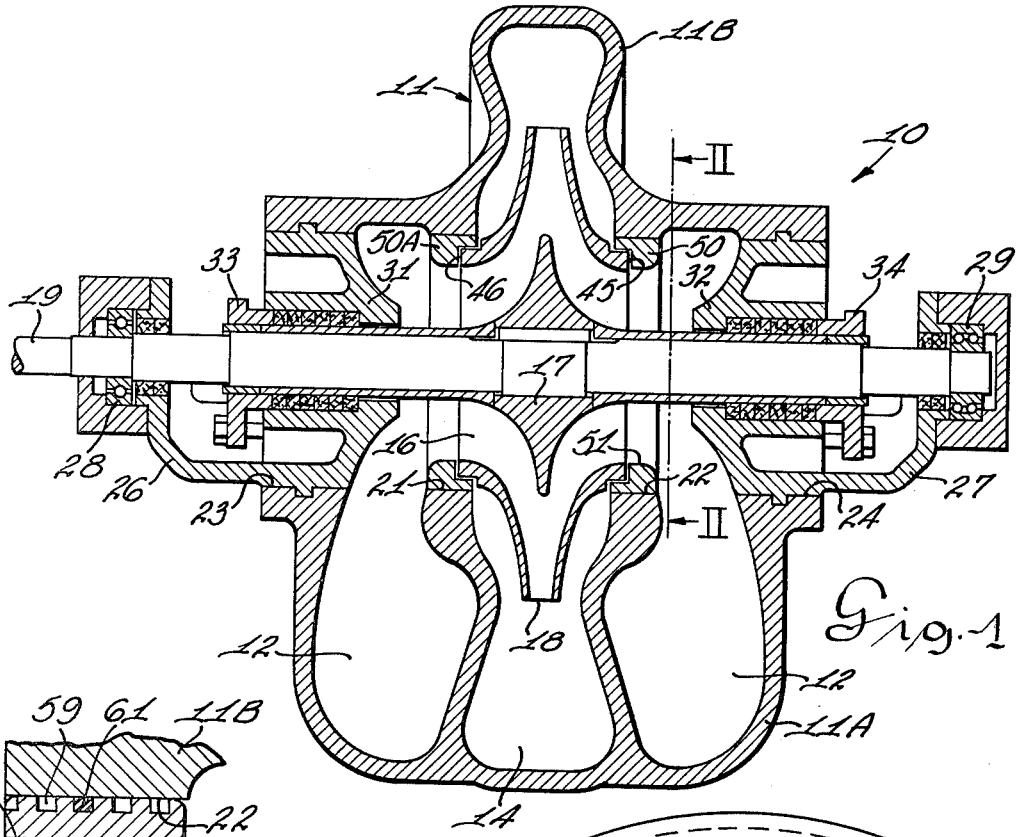
FIG. 1 is a vertical section view through a portion of a centrifugal pump showing the relationship of the wear ring component with respect to the pump impeller.

Referring more specifically to the drawing and particularly to FIG. 1, the invention is shown in connection with a centrifugal pump generally indicated by the reference number 10. The pump 10 includes a casing 11 having a bottom portion 11A and a top portion 11B which divide in a horizontal plane that passes through the axis of the shaft 19. The pump casing defines a suction cavity 12 and a discharge cavity 14 which are in communication by means of an eye 16 formed in a hub

17 of an impeller 18. The impeller 18 is mounted on a drive shaft 19 for rotation with the shaft. As shown, the impeller drive shaft 19 extends through axially aligned bores 21 and 22 formed in the casing 11 and also through axially aligned bores 23 and 24 which are coaxially aligned with the bores 21 and 22. Thus, with construction as depicted and because of the novel wear ring structure to be hereinafter set forth, it is possible to form the bores 21, 22, 23 and 24 in a single pass of a boring tool. Outboard supports 26 and 27 which extend from the sides of the casing 10 receive bearings 28 and 29 respectively in which the shaft 19 is rotatably supported. Stuffing boxes 31 and 32 with annular cavities through which the shaft 19 extends are filled with suitable packing material. Annular glands 33 and 34 in the outboard ends of the stuffing boxes operate to close off the stuffing boxes. The impeller 18 presents oppositely extending relatively short stepped sleeves 45 and 46, the O.D. of which are less than the I.D. of the bores 21 and 22.

Figure 3:
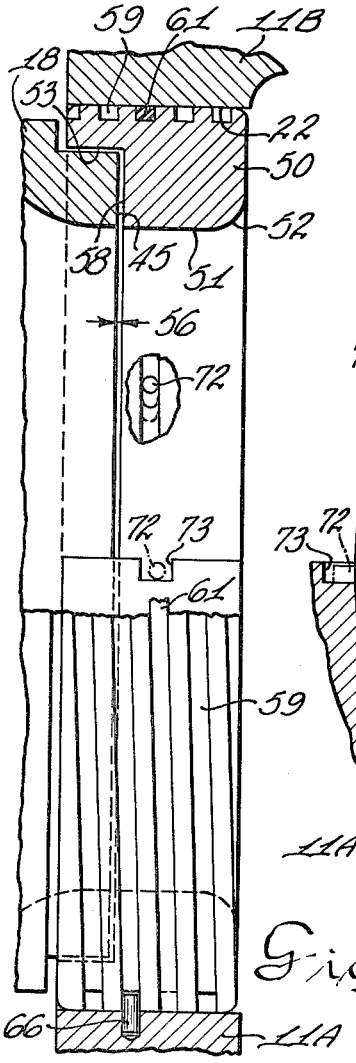
FIG. 3 is an enlarged fragmentary view showing partly in section and partly in side elevation the wear ring in greater detail with respect to the casing bore and the impeller.
Figure 2:
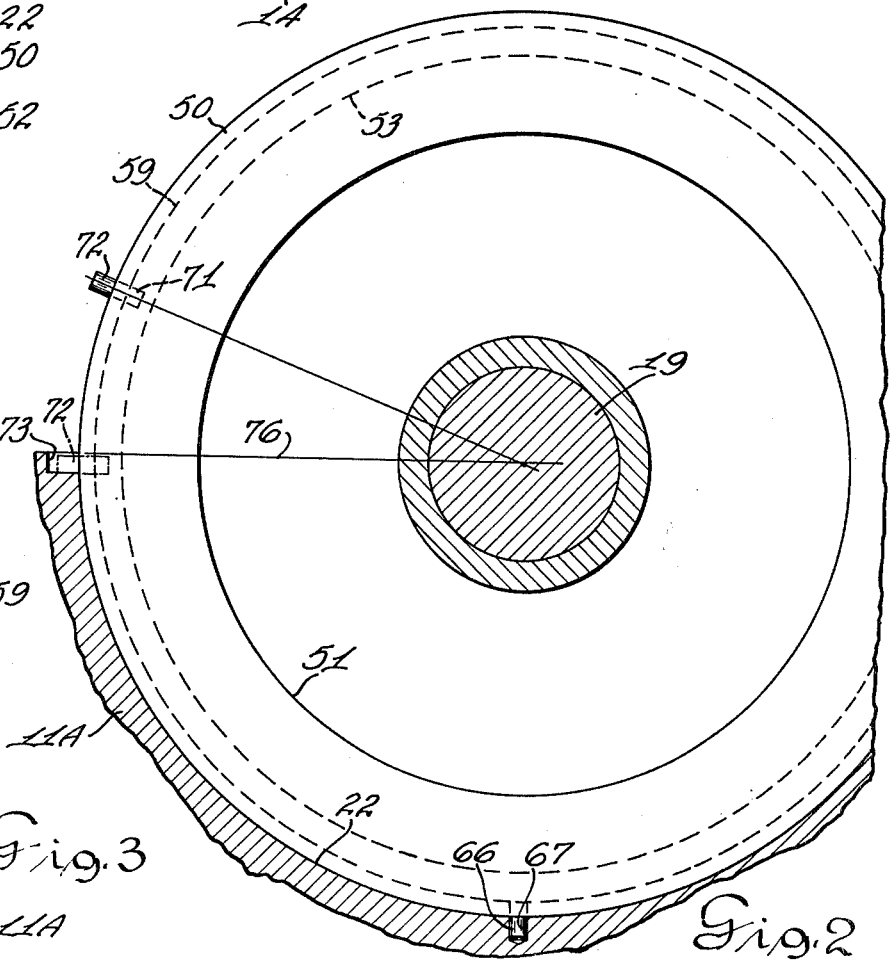
FIG. 2 is an enlarged fragmentary view in section of the wear ring showing the relationship of the pin guide with respect to the wear ring and casing bore taken in a plane represented by the line II—II in FIG. 1.

To provide a seal which will operate to prevent leakage between the suction cavity 12 and the discharge cavity 14 between the bores 21 and 22 and the hubs 45 and 46, respectively, there are provided multiple functioning ring members 50 and 50A which also serve as replaceable wear rings and are hereinafter referred to as wear rings. The wear rings 50 and 50A are identical and a description of the ring 50 will also apply to the wear ring 50A. As best shown in FIG. 3, the wear ring 50 is formed with an axial bore 51 through which fluid from the discharge cavity 14 flows into the suction cavity 12. The circular edge surface 52 is formed as a radius to provide smooth flow or nonturbulence characteristics to the fluid flowing through the ring. Since the wear ring 50, as the name implies, is subject to abrasive wear, it must be periodically replaced. Also the wear ring 50 must serve to effect a fluid seal to prevent leakage around the impeller wear surface face 45. To effect a sealing relationship between the wear ring 50 and the impeller wear surface face 45, the inner end of the wear ring 50 is provided with a counterbore 53 which receives the wear surface face 45 of the impeller. The wear ring 50 is moved axially inwardly toward the impeller a sufficient distance to provide a clearance space 56 between the axial end face of the impeller 45 and the shoulder 58 formed by the counterbore 53 in the wear ring. To effect a controlled axial movement of the wear ring 50 for adjustment purposes, the periphery of the wear ring 50 is formed with a spiral groove 59 of a plurality of turns. Each turn of the spiral groove 59 presents a squared configuration when viewed in cross section as shown in FIG. 3. One complete turn of the spiral groove receives a seal ring 61 of rubber-like material to prevent leakage between the bore 22 and the periphery of the wear ring. The seal ring 61 in cross section presents a square configuration which is slightly larger in thickness so that it will be compressed to tightly fill the spiral groove turn when the wear ring is in position within the bore 22.

To effect a controlled axial adjustment of the wear ring 50 inwardly into the bore 22 towards the impeller wear surface face, there is provided a pin 66. The pin 66 is fitted within a blind bore 67 formed in the wall of the bore 22. The wear ring 50 is rotated so as to engage the spiral groove 59 with the pin 66. Upon rotation of the wear ring 50, the spiral groove 50 on the pin 66 serves as a reactive member to effect the inward movement of the wear ring. The inward movement of the wear ring 50 is thereby controlled so that a predetermined dimension for the space 56 can be established. To this purpose, the wear ring 50 is rotated on the pin 66 until the surface of shoulder 58 engages with the wear surface face of the impeller sleeve 45. Upon this condition being obtained, a hole 71 is drilled radially into a turn of the spiral groove 59 of the wear ring 50 and a pin 72 inserted therein. The pin 72 is adapted to engage in an opening or slot 73 formed in the surface of the bore 22 in the lower portion 11A of the casing 11. Thus, with the wear ring 50 in engagement with the wear surface 58 of the impeller, the wear ring 50 will be backed off so as to engage the lock pin 72 in the slot 73. The angular distance that the wear ring 50 is backed off will establish the desired dimension of the space 56 and is determined by the distance between the face 76 of the lower portion 11A of the casing at the point of the bore 22 and a line that passes through the axis of the lock pin 72 which passes through the longitudinal axis of the shaft 19.

It is to be noted that the upper portion 11B of the casing does not have a slot similar to the slot 73. Therefore, the upper portion 11B of the casing captures the pin 72 in the slot 73 preventing any inadvertent rotation of the wear ring 50. The control pin 66 not only provides for a controlled axial movement of the wear ring but prevents any inadvertent axial movement of the wear ring. Thus, it is apparent that the dimension of the slot 73 in a direction parallel to the axis of the bore 22 is not critical since the axial movement of the wear ring 50 is controlled by the pin 66 which is dimensioned to closely match the width dimensions of the turns of the spiral groove 59.

From the foregoing description it is apparent that a novel and extremely useful wear ring and sealing arrangement have been provided for rotary pumps.

The embodiment of the invention in which an exclusive privilege is claimed is defined in the following appended claims:

1. In a centrifugal pump, having a casing and a rotary impeller, said casing having interior walls defining an inlet suction cavity and an outlet discharge cavity;

a bore formed in said interior walls through which fluid communication is established between the suction and discharge cavities;

an impeller rotatably supported in the discharge cavity and having an eye through which the fluid from the suction cavity flows through and into the discharge cavity;

an axial sleeve portion formed on said impeller, said sleeve portion having a peripheral reduced portion;

a wear ring supported within said bore;

a counterbore in one axial end of said wear ring adapted to receive the reduced portion of said sleeve;

control means for effecting controlled movement of said wear ring in said bore including a spiral groove of a plurality of turns formed in the peripheral circumference of said wear ring, each turn of said spiral groove presenting a squared configuration when viewed in cross section;

a reaction pin carried within said bore and extending radially inwardly into snug engagement with said spiral groove to cooperate therewith and provide a reaction force for effecting the controlled axial movement of said wear ring;

lock means associated with said wear ring and engageable with said casing to lock said wear ring in an adjusted axial position, said lock means includes a lock pin carried in periphery of said wear ring and extending radially outwardly therefrom; and, a slot formed in the wall of said bore of a predetermined length in which said lock pin is engaged to limit the rotation of said wear ring to a predetermined amount; whereby the angular distance that the wear ring is permitted to rotate will establish the desired spacing between the axial end face of the impeller and the shoulder face of the wear ring.

2. A centrifugal pump according to claim 1 wherein there is provided a sealing material in at least one turn of said spiral groove to effectively prevent fluid leakage between said wear ring and said bore.

* * * * *